United States Patent [19]

Washecheck et al.

[11] Patent Number: 4,534,852

[45] Date of Patent: Aug. 13, 1985

[54] SINGLE-STAGE HYDROTREATING PROCESS FOR CONVERTING PITCH TO CONVERSION PROCESS FEEDSTOCK

[75] Inventors: Don M. Washecheck, Katy; Charles T. Adams, Houston, both of Tex.

[73] Assignee: Shell Oil Company, Houston, Tex.

[21] Appl. No.: 676,742

[22] Filed: Nov. 30, 1984

[51] Int. Cl.[3] ..... C10G 45/06

[52] U.S. Cl. ..... 208/89; 208/210; 208/251 H

[58] Field of Search ..... 208/210, 216 R, 89, 208/251 H

[56] References Cited

U.S. PATENT DOCUMENTS

| | | | |
|---|---|---|---|
| 3,392,112 | 7/1968 | Bercik et al. | 208/210 |
| 4,006,076 | 2/1977 | Christensen et al. | 208/211 |
| 4,392,945 | 7/1983 | Howard et al. | 208/210 |
| 4,431,526 | 2/1984 | Simpson et al. | 208/251 H X |
| 4,444,655 | 4/1984 | Shiroto et al. | 208/251 H |

*Primary Examiner*—D. E. Gantz
*Assistant Examiner*—Glenn A. Caldarola

[57] ABSTRACT

A process is provided for converting pitch-containing residual hydrocarbon oils containing asphaltenes, sulfur and nitrogen compounds and heavy metals into distillate fuels, which comprises: mixing from about 5–60% v residual oils with catalytic cracking feedstock and with hydrogen and passing said mixture downwardly into a hydrotreating zone over a stacked-bed catalyst under conditions suitable to convert from about 45–75% of the sulfur compounds present in the mixture to $H_2S$; wherein said stacked bed comprises an upper bed consisting of from about 15–85 % v, basis total catalyst, of a high-activity hydrotreating catalyst which contains from about 2–4% w nickel, from about 8–15% w molybdenum and from about 2–4% w phosphorus supported on a carrier consisting mostly of alumina, and a lower bed of a high-activity, hydrodesulfurization catalyst consisting of from about 2–4% w cobalt and/or nickel, from about 8–15% w molybdenum and less than about 0.5% w phosphorus supported on a carrier consisting mostly of alumina; and separating the reaction product from said hydrotreating zone into a hydrogen-rich gas and a liquid residue-containing oil having reduced heavy metal content and being suitable as a catalytic cracking feedstock.

17 Claims, 6 Drawing Figures

FIG. 1
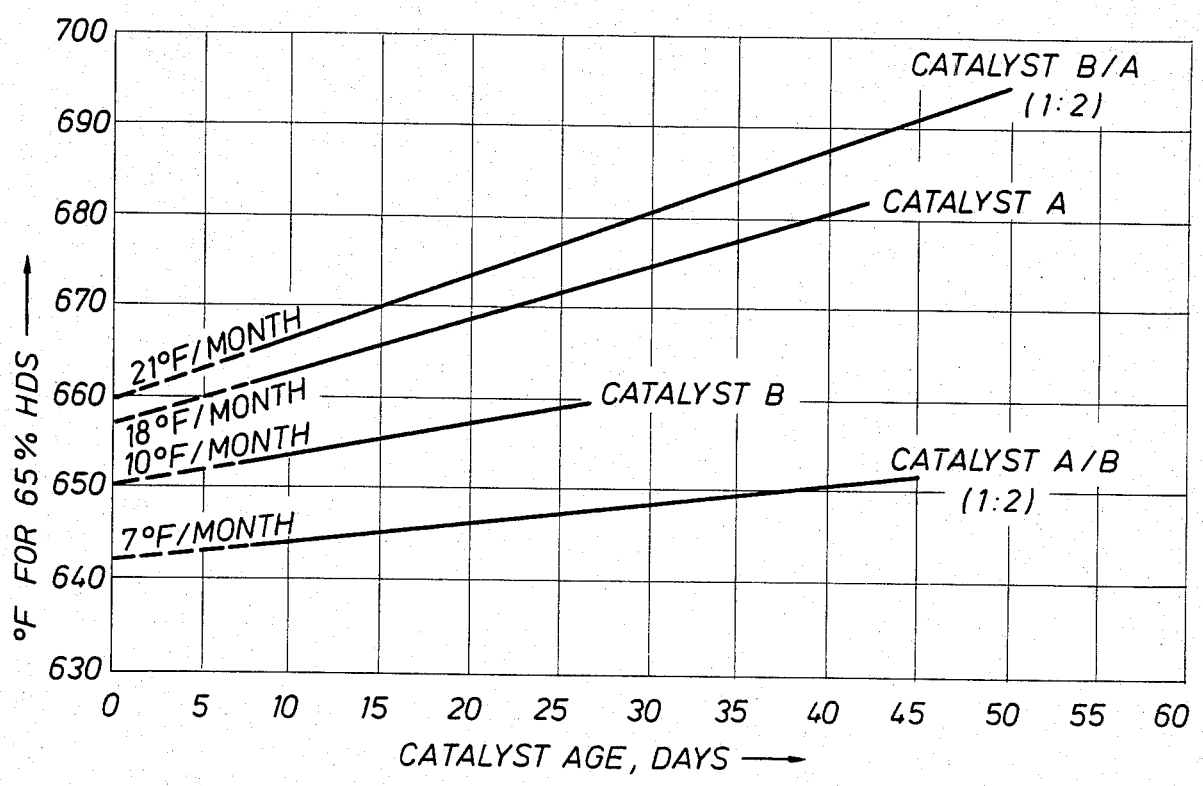
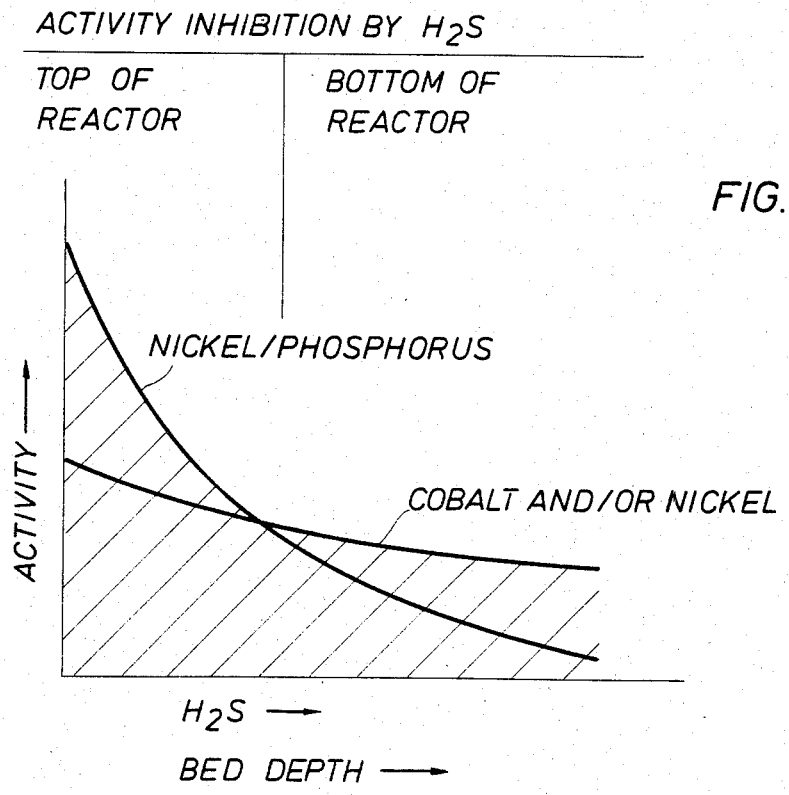
FIG. 3

FIG. 4
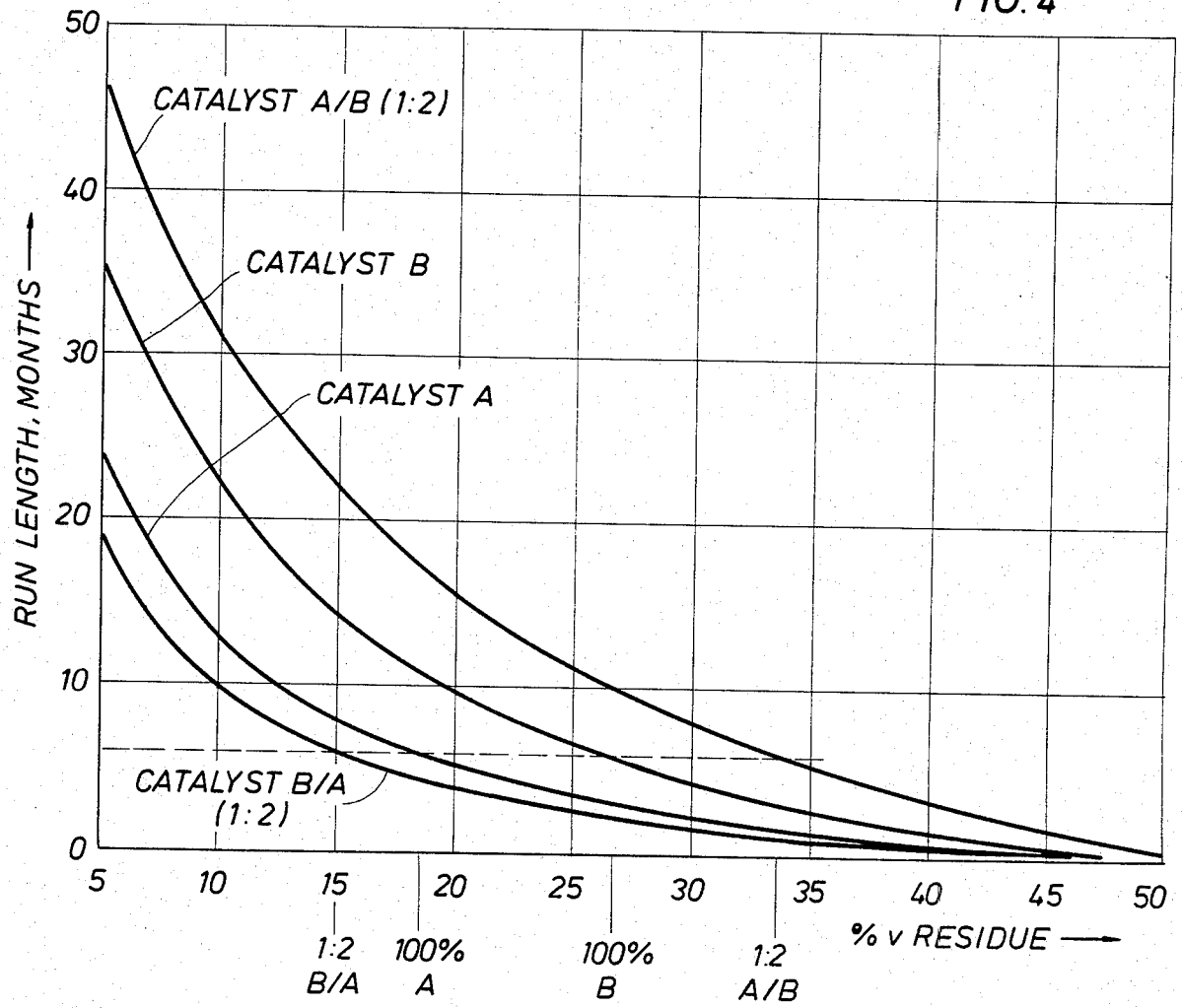
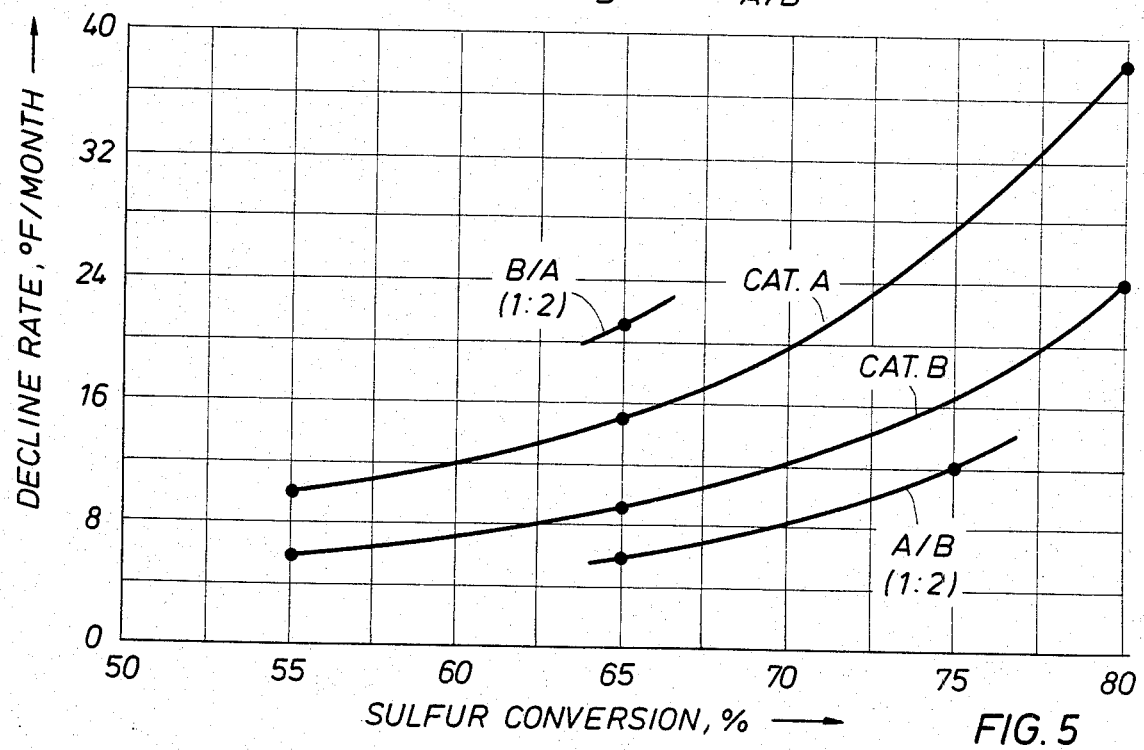
FIG. 5

SINGLE-STAGE HYDROTREATING PROCESS FOR CONVERTING PITCH TO CONVERSION PROCESS FEEDSTOCK

BACKGROUND OF THE INVENTION

This invention relates to a hydrotreating process for converting pitch to conversion process feedstock. It particularly relates to a single stage hydrofining process for converting high sulfur, heavy metals-containing residual oils into suitable catalytic cracking process feedstocks by utilizing a particular stacked-bed catalyst arrangement.

One of the difficult problems facing refiners is the disposal of residual oils. These oils contain varying amounts of pitch, i.e., oils with an atmospheric boiling point above 1000° F., which contain asphaltenes, sulfur and nitrogen compounds and heavy metals (Ni+V) compounds, all of which make them increasingly difficult to process in a conversion process, e.g., a catalytic cracking unit, as the pitch content increases. Asphaltenes deposit on cracking catalyst as coke, which rapidly deactivates the catalyst and requires greater coke-burning capacity. Sulfur and nitrogen compounds are converted to $H_2S$, $SO_2$, $SO_3$, $NH_3$ and nitrogen oxides during the cracking process and contaminate the atmosphere. Heavy metals deposit on the cracking catalyst and cause excessive cracking of the feedstocks to gases, thus reducing the yield of more valuable gasoline and distillate fuel oil components. Thus any process which enables refiners to convert a greater quantity of pitch-containing residual oils to gasoline and distillate fuels has great economic benefits.

It is well known that residual oils can be hydrotreated (hydrofined) to reduce the content of deleterious compounds thereby making them more suitable as a catalytic cracking feedstock. However, residual oil hydrotreating processes are very expensive because of rapid deactivation of catalyst and the need for high hydrogen partial pressures, which result in more expensive vessels to accomplish the required reduction of deleterious compounds with existing catalysts. Unless continuous regeneration facilities are provided, such processes require frequent catalyst replacement, which results in process unit downtime and requires larger vessels to process a given quantity of feedstock. If catalyst regeneration facilities are provided, two or more smaller reactor vessels are required so that deactivated catalyst in one reactor may be regenerated while the other reactor(s) continue to operate in the process. Of particular importance is the ability to process residue containing oils in existing hydrotreating units which do not have sufficient hydrogen pressure with existing catalysts to prevent unacceptably rapid catalyst activity loss. Thus improved processes and highly stable catalysts are in great demand.

Several two-stage hydrotreating processes have been proposed to overcome some of the difficulties of hydrotreating pitch-containing residual oils. The five patents discussed below use two catalyst reactor vessels, and are incorporated herein by reference.

U.S. Pat. No. 3,766,058 discloses a two-stage processes for hydrodesulfurizing high-sulfur vacuum residues. In the first stage some of the sulfur is removed and some hydrogenation of feed occurs, preferably over a cobalt-molybdenum catalyst supported on a composite of ZnO and $Al_2O_3$. In the second stage the effluent is treated under conditions to provide hydrocracking and desulfurization of asphaltenes and large resin molecules contained in the feed, preferably over molybdenum supported on alumina or silica, wherein the second catalyst has a greater average pore diameter than the first catalyst.

U.S. Pat. No. 4,016,049 discloses a two-stage process for hydrodesulfurizing metal- and sulfur-containing asphaltenic heavy oils with an interstage flashing step and with partial feed oil bypass around the first stage.

U.S. Pat. No. 4,048,060 discloses a two-stage hydrodesulfurization and hydrodemetallization process utilizing a different catalyst in each stage, wherein the second stage catalyst has a larger pore size than the first catalyst and a specific pore size distribution.

U.S. Pat. No. 4,166,026 teaches a two-step process wherein a heavy hydrocarbon oil containing large amounts of asphaltenes and heavy metals is hydrodemetallized and selectively cracked in the first step over a catalyst which contains one or more catalytic metals supported on a carrier composed mainly of magnesium silicate. The effluent from the first step, with or without separation of hydrogen-rich gas, is contacted with hydrogen in the presence of a catalyst containing one or more catalytic metals supported on a carrier preferably alumina or silica-alumina having a particular pore volume and pore size distribution. This two-step method is claimed to be more efficient than a conventional process wherein a residual oil is directly hydrodesulfurized in a one-step treatment.

U.S. Pat. No. 4,392,945 discloses a two-stage hydrorefining process for treating heavy oils containing certain types of organic sulfur compounds by utilizing a specific sequence of catalysts with interstage removal of $H_2S$ and $NH_3$. A nickel-containing conventional hydrorefining catalyst is present in the first stage. A cobalt-containing conventional hydrorefining catalyst is present in the second stage. The first stage is preferably operated under conditions to effect at least 50%w desulfurization, while the second stage is preferably operated under conditions to achieve at least about 90%w desulfurization, relative to the initial oil feed sulfur of the first stage. This process is primarily applicable to distillate gas oil feeds boiling below about 650° F. which contain little or no heavy metals.

All of the above referenced patents relate to two stage hydrotreating processes for various heavy hydrocarbon oils utilizing certain advantageous catalysts and/or supports. Some of these patents require interstage removal of $H_2S$ and $NH_3$ and others do not. However, none have described a process whereby large quantities of pitch-containing residual oil can be converted into a suitable conversion process, e.g., catalytic cracking feedstock, especially in a single hydrotreating stage. Applicants have found that by using a specific stacked-bed catalyst arrangement containing two different catalytically active compositions, large volumes of high sulfur, metals-containing residual oils can be converted into catalytic cracker feed in a single stage hydrotreating process. This process allows easy conversion of existing single catalytic cracker feed hydrotreater (CFH) reactors to a stacked bed of specified catalysts. The process operates well at hydrogen pressures below 1100 psig, so that no additional high pressure reactors need be constructed. The particular stacked bed combination of catalysts of the invention results in longer runs between replacements or regenerations (increased stability) than would be experienced with either catalyst used alone. Furthermore the stacked bed of the invention has a lower start of run temperature (increased activity) than with either catalyst alone or with other stacked bed combinations.

SUMMARY OF THE INVENTION

According to the present invention a process is provided for converting pitch-containing residual hydrocarbon oils containing asphaltenes, sulfur and nitrogen compounds and heavy metals into distillate fuels, which comprises: mixing from about 5–60%v residual oils with catalytic cracking feedstock and with hydrogen and passing said mixture downwardly into a hydrotreating zone over a stacked-bed catalyst under conditions suitable to convert from about 45–75% of the sulfur compounds present in the mixture to $H_2S$; wherein said stacked bed comprises an upper bed consisting of from about 15–85%v, basis total catalyst, of a high-activity hydrotreating catalyst which contains from about 2–4%w nickel, from about 8–15%w molybdenum and from about 2–4%w phosphorus supported on a carrier consisting mostly of alumina, and a lower bed of a high-activity, hydrodesulfurization catalyst consisting of from about 2–4%w cobalt and/or nickel, from about 8–15%w molybdenum and less than about 0.5%w phosphorus supported a carrier consisting mostly of alumina; and separating the reaction product from said hydrotreating zone into a hydrogen-rich gas and a liquid residue-containing oil having reduced heavy metal content and being suitable as a catalytic cracking feedstock.

BRIEF DESCRIPTION OF THE DRAWINGS

FIG. 1 is a graph showing catalyst decline rates at 65% hydrodesulfurization for catalysts A and B individually and in two stacked bed arrangements.

FIG. 3 is a graph comparing the hypothesized activity of nickel/phosphorus-containing catalyst with that of cobalt- and/or nickel-containing catalyst at various $H_2S$ concentrations (bed depths).

FIG. 4 is a graph showing the estimated run lengths for Catalyst A and B individually and in two stacked bed arrangements for various residue contents in the feedstock.

FIG. 5 is a graph showing catalyst activity decline rate for catalysts A and B individually and in two stacked bed arrangements at sulfur conversion levels from 55–80%.

DETAILED DESCRIPTION OF THE INVENTION

Figure 2:
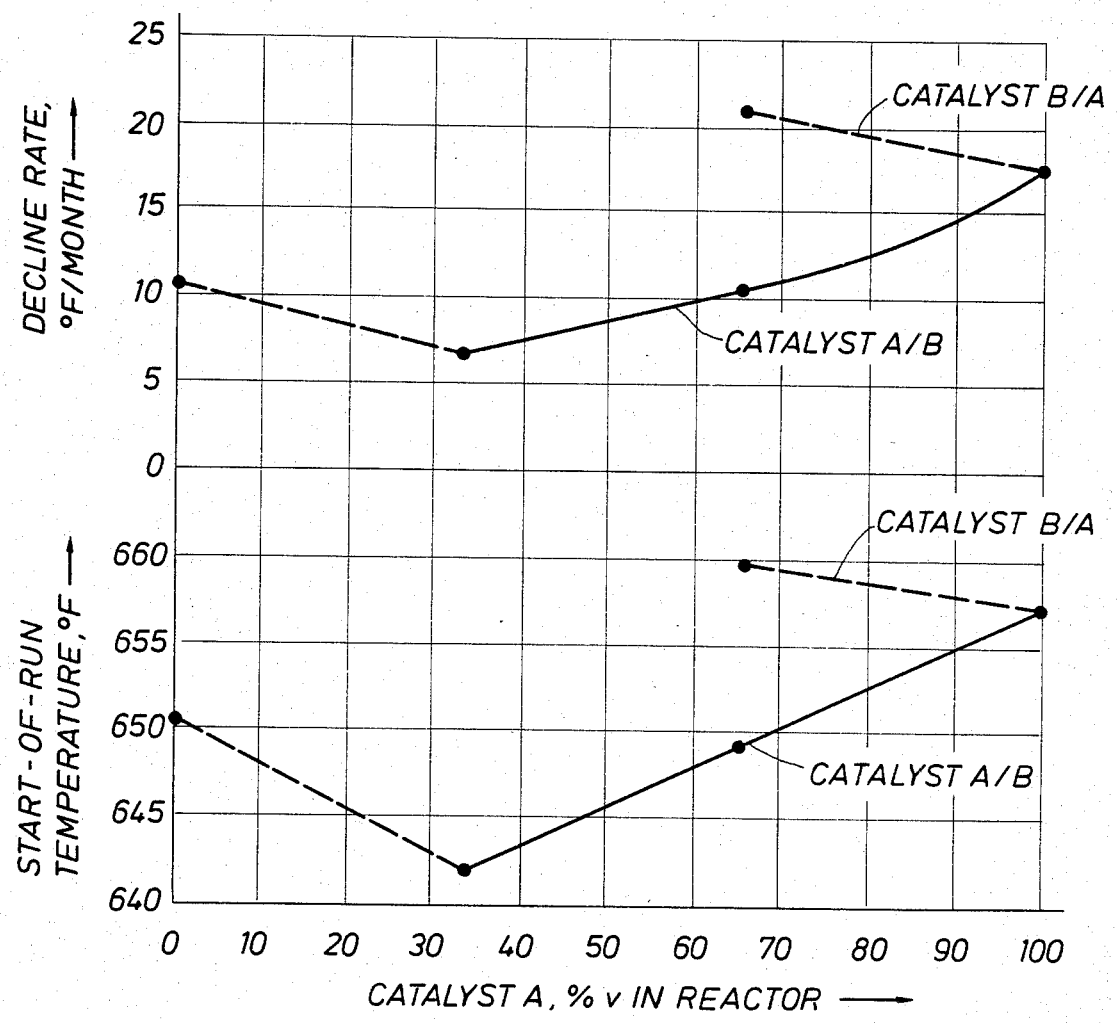
FIG. 2 is a graph comparing three performance properties at 65% hydrodesulfurization for catalysts A and B individually and in three stacked bed arrangements.

Residual oil upgrading by inclusion of residue in the feed to a catalytic cracking feed hydrotreater/fluid catalytic cracking unit complex is economically very attractive. Coke precursors and metals in such a blend deactivate FCC catalysts and lead to increased light gas make. Prior hydrotreatment of feed blends is necessary in order to reduce the coke precursors (RCR, nitrogen, and aromatics), metals content (Ni, V, Na), and heteroatom (S,N) content. Metals and coke precursors in the feed also deactivate CFH catalyst. A more stable and active catalyst will allow processing of increased amounts of residue in existing equipment with large economic incentives.

Extensive development of improved catalytic cracking feed hydrotreating (CFH) catalyst for processing heavier feed stocks has been undertaken. Several catalysts were selected for testing to determine longer term performance. Data were obtained relating to stabilities, hydrodesulfurization (HDS), nitrogen, nickel, vanadium, RCR, aromatics saturation, and hydrogenation activities with a feed blend containing 25% atmospheric residue at conditions which simulate commercial catalytic cracker feed hydrotreater (CFH) operation. These studies revealed a catalyst which can process the feed blend specified at 55% desulfurization for at least 12 months before regeneration or replacement of the catalyst is required.

Four catalysts were examined initially. Their properties are given in Table A. Three of the catalysts were Ni promoted and one was Co promoted. All four catalysts were supported on alumina. Catalyst 1 and 2 were both Ni/Mo/P formulations which differed primarily in their support. Catalyst 1 was supported on a wide-pore low surface area cylinder extrudate, while Catalyst 2, 3 and 4 were supported on a trilobe high surface area extrudate. Catalysts 3 and 4 contained no phosphorus.

TABLE A

| | CATALYST PROPERTIES | | | |
|---|---|---|---|---|
| CATALYST SHAPE | 1 CYL-INDER | 2 TRI-LOBE | 3 TRI-LOBE | 4 TRI-LOBE |
| COMPOSITION, % w | | | | |
| Co | — | — | 3.6 | — |
| Ni | 2.7 | 3.36 | — | 3.2 |
| Mo | 13.2 | 13.25 | 10.8 | 12.8 |
| P | 3.0 | 3.16 | — | — |
| COMPACTED BULK DENSITY, g/cc | 0.889 | 0.801 | 0.713 | 0.739 |
| SURFACE AREA, $M^2$/gm | 123 | 163 | 229 | 215 |

The activities of the catalysts were determined for various degrees of sulfur conversions at various catalyst ages. The Co/Mo catalyst (Cat. 3) was about 5° F. more active than the Ni/Mo catalyst (Cat. 4). The no-phosphorus Ni/Mo catalyst (Cat. 4) was about 12° F. less active than its Ni/Mo/P counterpart (Cat. 3). The wide-pore low surface area Ni/Mo/P catalyst (Cat. 1) had about the same activity as the no-phosphorus Ni/Mo catalyst (Cat. 4) reflecting the offsetting effect of lower surface area versus the promotion of phosphorus. Although the Co/Mo catalyst is the most active of the group, its activity relative to the Ni/Mo/P is not greatly different as is frequently observed with lighter feeds. This small difference is thought to be due to significant activity suppression by the residue in the feed stock.

Catalyst stabilities (rate of temperature increase) were also determined at various conversions of sulfur and catalyst ages. Table B summarizes the activities (temperature required) and stabilities at 55% sulfur removal. Higher decline rates were observed for phosphorus containing catalysts relative to catalyst without phosphorus. The presence of phosphorus may promote coke formation via an acid catalyzed condensation of coke precursors. Phosphorus also reduces the catalyst surface area on a weight basis and occupies some of the support volume, thereby reducing the volume and area available for coke deposition.

TABLE B

| CATALYST | START-OF-RUN °F. | DECLINE RATE °F./MONTH |
|---|---|---|
| 1 | 643 | 12 |
| 2 | 632 | 10 |
| 3 | 627 | 7 |
| 4 | 646 | 7 |

Coking is the primary mechanism of catalyst deactivation under these conditions. The wide-pore catalyst (Cat. 1) would be expected to be the most stable under conditions of deactivation by metals deposition. Metals deposit in the pore mouths of catalyst resulting in deactivation through pore-mouth plugging, a process well known to the art. A large pore mouth results in less deactivation via pore-mouth plugging. As can be seen in Table B, the wide-pore catalyst (Cat. 1) is the least stable of the group of catalysts and thus supports a coking deactivation mechanism.

Nitrogen removal is an important factor in increasing the quality of a feed for catalytic cracking. Catalysts without phosphorus are more stable with the residue containing blends under the conditions noted above; howver, nitrogen removal activity is low for no-phosphorus catalysts relative to their phosphorus promoted counterparts. Additionally, Co promoted catalysts are less active for nitrogen removal than are Ni promoted catalysts. Stacked catalyst beds can be used to tailor the amount of nitrogen removal, sulfur and metals removal, and system stability. We have discovered that a stacked bed system also improves activities (other than nitrogen removal) as well as the stability of the overall catalyst system relative to either catalyst used individually. The stacked bed catalyst system is applicable when processing feeds under conditions where a heavy feed is causing deactivation primarily by coking.

According to the present invention residual oil is mixed with gas oils typically fed to catalytic cracking feed hydrotreaters, combined with a hydrogen containing gas and passed serially over the stacked bed catalyst system. Residue is characterized as having high levels of sulfur, heavy metals, carbon residue (Ramsbottom or Conradson), and significant volumes boiling greater than 1000° F. at atmospheric pressure. The amount of residue that can be mixed with the gas oils is from about 2–24%v of pitch or material boiling above 1000° F. Preferably the percentage is from about 8–20%w. Atmospheric residue contains nominally about 40% by volume of material boiling above 1000° F. depending upon the nature of the crude. The amount of atmospheric residue that can be blended with the gas oils is from about 5–60% on a volume basis. Preferably, the amount of atmospheric residue is from about 15 to 50% on a volume basis.

The quantity of residue that can be processed will depend primarily upon the unit conditions, conversion targets, and residue quality. Guidelines for suitable ranges of residue properties are shown in Table C, but are not limited to these parameters.

TABLE C

| PROPERTY | BROAD RANGE | PREFERRED RANGE |
|---|---|---|
| Sulfur, % w | .2–8 | 1.5–2.5 |
| Ni + V, ppmw | 1–100 | 20–50 |
| Nitrogen, % w | 0–1 | 0.1–0.3 |
| Ramsbottom Carbon Residue, % w | 1–25 | 3–8 |

TABLE C-continued

Below about 2%v pitch in the feed blend conventional catalysts are capable of processing the feed blend since catalyst stability generally would not be a problem. Above 24%v pitch the deactivation due to the pitch in the feed is too large for practical commercial operation unless the hydrogen pressure is high; in which case, as detailed below, prior art catalyst systems are suitable.

The residue may be blended with vacuum gas oils and/or atmospheric distillates taken from crude oil (straight run) or from cracked products or both. It is preferred to blend the residue with vacuum gas oils. Vacuum gas oils may also contain materials boiling above 1000° F. At sufficiently low hydrogen pressures and high enough conversion levels, heavy vacuum gas oils can cause significant activity declines. The stacked bed system revealed herein is suitable for increasing the stability of such an operation.

The first main hydrotreating zone catalyst used in the present invention is a Ni- and P-containing conventional hydrotreating catalyst. Conventional hydrotreating catalysts which are suitable for the first catalyst zone generally comprise a phosphorus oxide and/or sulfide component and a component, selected from group VIB of the Periodic Table and a group VIII metal, metal oxide, or metal sulfide and mixtures thereof composited with a support. These catalysts will contain from 0 to 10 percent, usually 1 to 5 percent by weight of the group VIII metal compound calculated basis the metal content, from 3 to 15 percent by weight of the group VIB metal compound calculated basis the metal content, and from 0.1 to 10 percent phosphorus compounds calculated basis phosphorus content. Preferably the catalyst comprises a nickel component and a molybdenum and/or tungsten component with an alumina support which may additionally contain silica. A more preferred embodiment is a nickel component, a molybdenum component, and a phosphorus component with an alumina support which may also contain silica in small amounts. Preferred amounts of nickel component is from 2 to 4 percent by weight calculated basis metal content, 11–15 percent by weight of the molybdenum component calculated basis metal content, and 2 to 4 percent of the phosphorus component calculated basis the phosphorus content. The catalyst can be used in a variety of shapes. The preferred shape is a trilobe extrudate. Preferably the catalyst is sulfided prior to use as is well known to the art.

The Ni-containing catalyst used for the first zone is preferably a high activity conventional catalyst suitable for high levels of hydrogenation. Such catalysts have high surface areas (greater than 140 $m^2/gm$) and high densities (0.7–0.95 gm/cc). The high surface area increases reaction rates due to generally increased dispersion of the active components. Higher density catalysts allow one to load a larger amount of active metals and promoter per reactor volume, a factor which is commercially important. The metal and phosphorus content specified above provides the high activity per reactor volume. Lower metal contents result in catalyst with activity too low for use in the present invention. Higher metal contents lead to an inefficient use of the metals and higher cost for the catalyst. Since deposits of coke are thought to cause the majority of the catalyst deactivation, the catalyst pore volume should be maintained at a modest level (0.4–0.6).

A low-phosphorus or no-phosphorus conventional hydrotreating catalyst is used in the second zone of the catalyst system. Either Co containing and/or Ni containing conventional catalysts could be used. This catalyst differs from the first catalyst primarily in the low-phosphorus content (less than 0.5%w). The preferred catalyst contains less than 0.5%w phosphorus and may comprise a component from group VIB and a group VIII metal, metal oxide, or metal sulfide and mixtures thereof composited with a support. Preferably the catalyst comprises a nickel and/or cobalt component and a molybdenum and/or tungsten component with an alumina support which may additionally contain silica. Preferred metal contents are from 0 to 10 usually 1 to 5 percent by weight of the group VIII metal components calculated basis the metal content and from 3 to 30 percent by weight of the group VIB metal component basis the metal content. A more preferred embodiment is a cobalt component and a molybdenum component with an alumina support. The catalyst can be used in a variety of shapes. The preferred shape is a trilobe extrudate. Preferably the catalyst is sulfided prior to use as is well known to the art.

The use of low- or no-phosphorus catalysts in the second zone is thought to be of benefit due to reduced deactivation by coking. Phosphorus may promote coking through an acid catalyzed condensation of coke precursors. A high activity catalyst is desired in order to reduce the required operating temperatures. High temperatures lead to increased coking.

The low-phosphorus content catalyst used for the second zone is preferably a high activity conventional catalyst. Such catalysts have high surface areas (greater than 200 $m^2$/gm) and high compacted bulk densities (0.6–0.85 gm/cc). The high surface area increases reaction rates due to generally increased dispersion of the active components. Higher density catalysts allow one to load a larger amount of active metals and promoter per reactor volume, a factor which is commercially important. The metal content specified above provides high activity per reactor volume. Lower metal contents result in catalysts with activity too low for use in the present invention. With higher metal loading than specified above, inefficient use of the metals results in high catalyst cost with little advantage. Since deposits of coke are thought to cause the majority of the catalyst deactivation, the catalyst pore volume should be maintained at or above a modest level (0.5–0.7).

The relative volumes of the two catalyst zones in the present invention is from about 15 to 85%v of the main catalyst bed to comprise the first catalyst. The remaining fraction of the main catalyst bed is composed of the second catalyst. The division of the bed depends upon the requirement for nitrogen conversion versus the requirements for stability and other hydrotreating reactions such as sulfur and metals removal. Below a catalyst ratio of 15:85 or above a catalyst ratio of 85:15 (upper:lower) the benefits for the stacked bed system are not large enough to be of commercial use. There is no physical limit on using a smaller percentage of one or the other beds.

The catalysts zones revealed in this invention may be in the same or different reactors. For existing units with one reactor the catalysts are layered one on top of the other. Many hydrotreating reactors consist of two reactors in series. The catalyst zones are not restricted to the volume in one vessel and can extend into the next vessel. The zones discussed in this invention refer to the main catalyst bed. Small layers of catalysts which are different sizes are frequently used in reactor loading as is known to those skilled in the art. Intervessel heat exchange and/or hydrogen addition may also be used with this invention.

The pore size of the catalyst is not a critical factor in the present invention. The catalysts in the two zones may use the same carrier. The finished catalysts will have a small difference in their average pore size due the the differences in metal and phosphorus loadings.

Suitable operating conditions for the catalyst system are given in Table D.

TABLE D

| CONDITIONS | BROAD RANGE | PREFERRED RANGE |
|---|---|---|
| Hydrogen Partial Pressure, psia | 300–1100 | 500–800 |
| Total Pressure, psig | 400–1400 | 700–1100 |
| Hydrogen/Oil Ratio, SCF/BBL | 100–5000 | 500–1500 |
| Temperature, °F. | 550–850 | 650–800 |
| Liquid hourly space velocity, V/V/HR | 0.1–10.0 | 0.5–5.0 |

At temperatures below about 550° F. the catalysts do not exhibit sufficient activity for heavy feeds for the rates of conversion to be practical. At temperatures above about 850° F. the rate of coking and cracking become excessive resulting in impractical operations.

At space velocities below about 0.1 Hr-1, the residence time of the oil is long enough to lead to thermal degradation and coking. At space velocities above about 10 Hr-1 the conversion across the reactor is too small to be of practical use.

Hydrogen partial pressure is very important in determining the rate of catalyst coking and deactivation. At pressures below about 300 psia, the catalyst system cokes too rapidly even with the best quality residual-containing oil. At pressures above about 1100 psia, the deactivation mechanism of the catalyst system is predominantly that of metals deposition which results in pore-mouth plugging. Catalysts of varying porosity can be used to address deactivation by metals deposition, as is known by those skilled in the art. The hydrogen to oil ratio for this invention is required to be above 100 SCF/BBL since the reactions occurring during hydrotreating consume hydrogen resulting in a deficiency of hydrogen at the bottom of the reactor. This deficiency results in rapid coking of the catalyst and an impractical operation. At hydrogen to oil ratios above 5000 SCF/BBL no benefit is obtained; thus the expense of compression beyond this rate is not warranted.

Current catalysts would have allowed processing residue-containing feedstocks, but with catalyst change-outs about every 6 months. We have discovered an improved catalyst system which will allow processing such feeds at a higher conversion for more than a year. It is estimated, however, that a greater return would be had by increasing the amount of the pitch that is processed rather than by extending the catalyst life beyond 9–12 months.

The following examples are presented to illustrate the invention.

EXAMPLE 1

Catalyst A contains nickel, molybdenum and phosphorus supported on a gamma alumina carrier, prepared from commercially available alumina powders. This carrier was extruded into 1/16-inch pellets having a trilobe cross section and the pellets were dried and calcined before being impregnated with catalytically active metals by a dry pore volume method i.e., by adding only enough solution to fill the alumina pore volume. Although this carrier contained only alumina, it could have contained a few percent of other components like silica or magnesia, say up to 5%w. An aqueous solution of nickel nitrate, nickel carbonate, phosphoric acid, hydrogen peroxide, ammonium heptamolybdate and molybdenum trioxide was used to impregnate the carrier. The metals loading and the properties of the dried, calcined catalyst are given in Table E.

EXAMPLE 2

Catalyst B contains cobalt and molybdenum supported on the same alumina carrier used to prepare Catalyst A. This carrier was also extruded into 1/16-inch pellets having a trilobe cross-section and the pellets were dried before being impregnated with catalytically active metals by a dry pore volume method. An aqueous solution of cobalt carbonate, ammonium dimolybdate and ammonia was used to impregnate the carrier. The metals loading and properties of the dried, calcined catalyst are also given in Table E.

TABLE E

| Catalyst | A | B |
|---|---|---|
| Diameter | 1/16 inch | |
| Cross-section | Trilobe | |
| Composition, % w | | |
| Ni | 3.0 | — |
| Co | — | 3.2 |
| Mo | 13.0 | 9.6 |
| P | 3.2 | — |
| Compacted Bulk Density, gm/cc | 0.824 | 0.710 |
| Surface Area, $m^2$/gm | 164 | 226 |
| Hg-Pore Volume, cc/gm | 0.470 | .605 |

EXAMPLE 3

Catalysts A and B were tested for their ability to hydrotreat a simulated catalytic cracking feedstock containing a large amount of straight run residue in a blend of more typical distillate gas oil feeds. These catalysts were tested both singly and in various stacked-bed configurations. Three stacked-bed catalyst systems were examined. All three divide the reactor into thirds on a volume basis. The systems tested were 1:2 Ni/P-:Co, 2:1 Ni/P:Co and 1:2 Co:Ni/P; the catalyst listed first represents the catalyst loaded in the top of the reactor.

The feedstock used in these tests was a mixture of flashed distillates and atmospheric residue (25%v). Properties of the feed are given in Table F. Conditions used in testing (850 psig $H_2$; 1.2 LHSV; and 1000 SCF-Total $H_2$/B) simulate many typical commercial CFH units. Pure once-through hydrogen was used. Reactor temperatures were adjusted to maintain 65% sulfur conversion. Data were corrected for minor temperature and space velocity offsets by standard power-law kinetics.

TABLE F

| | RESIDUE | BLEND |
|---|---|---|
| Composition, % wt. | | |
| Carbon | 85.36 | 86.12 |
| Hydrogen | 11.51 | 11.37 |
| Sulfur | 2.38 | 2.05 |
| Nitrogen | .223 | .16 |
| Nickel | 14 | 5.0 |
| Vanadium | 17 | 7.6 |
| Ramsbottom Carbon | | |
| Residue, % wt. | 5.94 | 2.00 |
| API Gravity | 18.0 | 19.8 |
| TBP-GLC, wt % | | |
| 400 | 1 | — |
| 500 | 2 | 2 |
| 600 | 8 | 8 |
| 700 | 17 | 24 |
| 800 | 33 | 44 |
| 900 | 47 | 68 |
| 1000 | 57 | 85 |

TABLE G

| CATALYST SYSTEM | | | SOR[a] | DECLINE RATE |
|---|---|---|---|---|
| TOP | BOTTOM | RATIO(T:B) | °F. | °F./MO |
| Cat. A | Cat. B | 1:2 | 641.8 | 6.7 |
| Cat. B | Cat. A | 1:2 | 659.5 | 21.0 |
| Cat. A | Cat. B | 2:1 | 650.4 | 10.4 |
| Cat. A | — | 100% | 657.0 | 17.7 |
| Cat. B | — | 100% | 650 | 10 |

[a]SOR = Start of Run Temperature for 65% desulfurization.

FIG. 1 shows the temperatures required for 65% HDS versus catalyst age for two of the stacked bed combinations and for the single bed Ni/P- and Co-promoted catalysts. Data for the 2:1 Ni/P-over-Co stacked-bed system are not shown in FIG. 1 but were similar to the Catalyst B data (see Table G). Decline rates were constant over the course of the experiments. Least squares analysis was used to determine start-of-run temperatures and decline rates. Each of the conversion of RCR, Ni, and Vi and the hydrogen consumption for the 5 catalyst systems were equal at equal HDS activity. Differences in the decline rates for each of these activities relative to HDS activity were not observed for any of the 5 catalyst systems (3 stacked bed and 2 single bed); temperature increases to maintain HDS activity also held other activities constant. Start-of-run temperature and stability advantages for HDS activities also apply to these other activities. Start-of-run temperatures and activity decline rates are given in Table G.

Although the other activities remained constant for each catalyst at fixed HDS activity, some differences were observed when the different stacked-bed catalyst systems were compared. Differences were observed in start-of-run temperatures, decline rates and nitrogen activities. FIG. 2 summarizes these differences for the 5 different catalyst bed combinations. Stability and activity advantages were found for the stacked-bed systems of the same catalyst volume ratios when Ni-Mo-P catalysts were in the top of the reactor rather than in the bottom. Additional stability and activity advantages relative to either of the individual catalysts were found for the system with the Ni-Mo-P (Cat. A) occupying the top ⅓rd of the reactor volume. Nitrogen removal activity was a linear combination of the amount of Ni-Mo-P and Co-Mo catalysts in the system regardless of stacking order. Catalyst A had the highest HDN activities of the systems examined.

EXAMPLE 4

FIG. 3 illustrates a hypothesis for the activity advantages of the stacked-bed system and the preferred stacking order of the catalysts. The figure shows activity versus the concentration of $H_2S$. Ni-P promoted (Catalyst A) is thought to be intrinsically more active for coke-precursor hydrogenation than non-phosphorus promoted (Catalyst B) catalysts; however, Ni/P-promoted catalysts are more susceptible to inhibition by $H_2S$. As oil passes down a reactor, $H_2S$ is released and hydrogen is consumed thus increasing the concentration of $H_2S$. As shown in FIG. 3 the activities cross after the concentration of $H_2S$ reaches a certain level. Increased overall activity can be obtained by using a Ni-Mo-P catalyst in the top of the reactor where the $H_2S$ concentration is low and then switching to a Ni-Mo or Co-Mo catalyst without phosphorus at the point where the $H_2S$ level is high enough that the activities of the two catalysts are equal. Coke precursors are thought to supress other hydrotreating activities through a competitive adsorption inhibition. The precursors adsorb on the active sites more strongly than do other reactants and thereby prevent them from reacting. In the tests shown in Example 3 the activity differences observed for Ni-over-Co versus Co-over-Ni in a 1:2 split were 20° F. for HDS. The split of 1:2 was used rather arbitrarily. It is not known if this is the optimum ratio.

Our hypothesis for stability differences among stacked beds is based on possible differences in hydrogenation of small quantities of coke precursors. Stacked beds with Ni/P-promoted catalysts in the top are thought to hydrogenate more coke precursors than do non-phosphorus promoted catalysts. The stability of the preferred stacked bed system could then be related to the proposed differing $H_2S$ inhibition outlined above due to suppression of the coke precursor hydrogenation ability of the catalysts. A stability versus bed depth curve similar to the activity curve could be drawn. (FIG. 3)

EXAMPLE 5

Optimum profit in commercial applications for the catalyst systems summarized would probably not be attained at equal sulfur conversion but more nearly at equal run-lengths. Cost of catalyst change-out and lost production would then be nearly equal. Equal run-length can be obtained in either by increasing the severity i.e., temperature and thereby conversion, or by increasing the amount of residue blended into the feed, thereby suppressing the catalyst(s) activity and increasing the rate of catalyst(s) decline.

FIG. 4 illustrates the estimated run lengths for Catalysts A, B, and two of the single stage stacked-bed arrangements when processing at conditions described in Example 3 and with varying amounts of a residue in a blend similar to that discussed therein. The more stable and active (sulfur, Ni, V and RCR) single stage stacked-bed arrangement (A:B, 1:2) will allow increased amounts of residue to be processed relative to either Catalyst A or Catalyst B, taken individually, or to the single stage stacked-bed arrangement wherein Catalyst B is used in the upper portion of the reactor. This advantage is illustrated in FIG. 4 by the horizontal dashed line indicating a fixed run length. The points of intersection of this line with the curves show the estimated volume % of residue that could be processed; the preferred single stage stacked-bed arrangement has a significant advantage relative to the other cases, in the amount of residue that can be processed at a fixed run-length. The preferred stacked-bed arrangement can process ~33 volume percent of the residue versus only 15 to 27 volume percent for the other systems.

Figure 6:
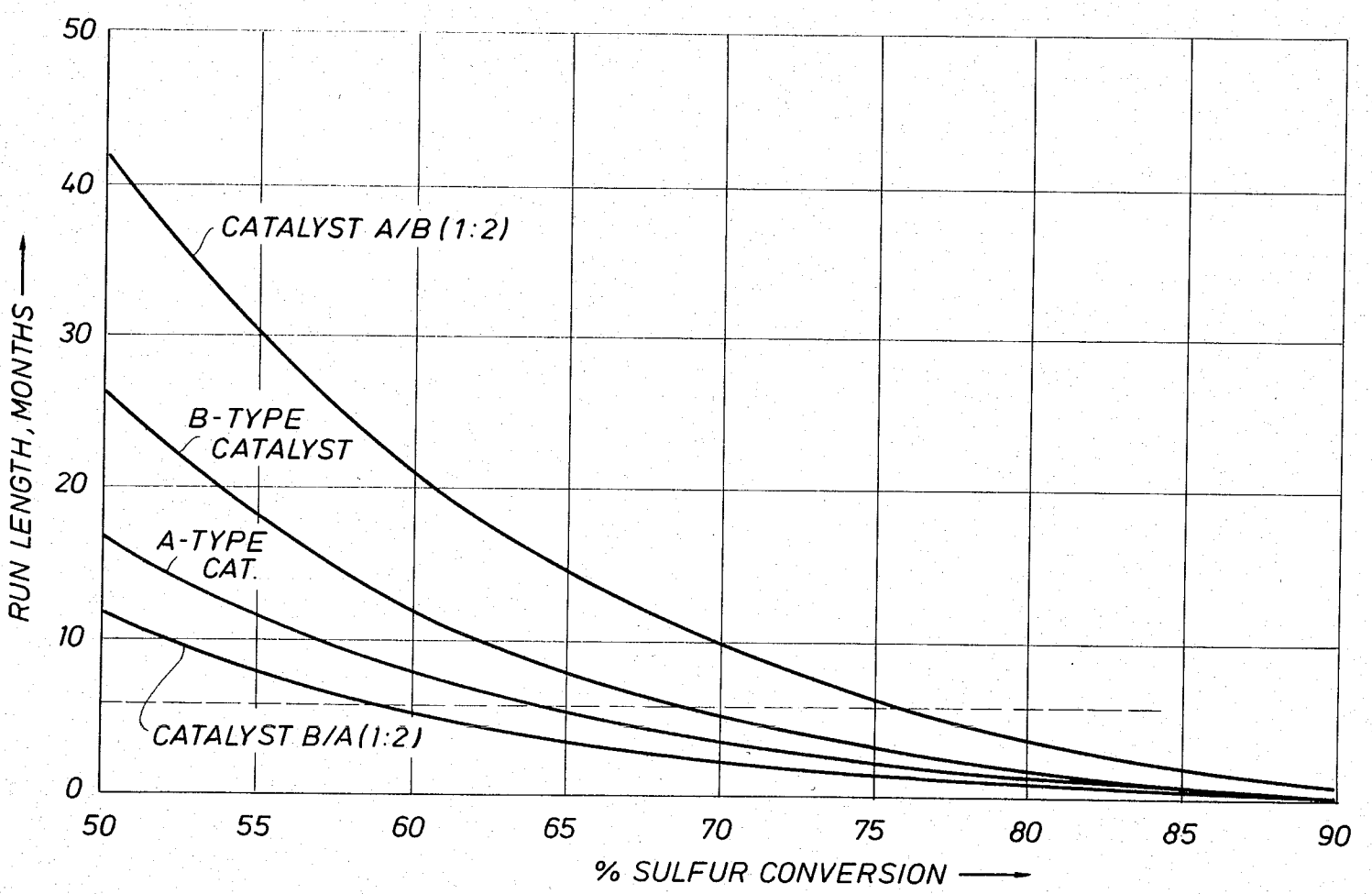
FIG. 6 is a graph showing the estimated run lengths for catalysts A and B individually and in two stacked bed arrangements at various sulfur conversion levels.

The stability and activity advantages of the preferred single stage stacked-bed system can be used to increase sulfur conversion while maintaining the same run-length as other catalysts. FIGS. 5 and 6 illustrate this concept. FIG. 5 shows the increase in decline rate with increasing sulfur conversion. FIG. 6 shows the run-length estimated from these data. The preferred single stage stacked-bed system converts 7% (76 vs. 69) more sulfur at a run length of 6 months than does the best single catalyst system. The preferred single stage stacked-bed system, 1:2 A:B, converts 16% (~76 vs. 60) more sulfur at a run length of 6 months than does the 1:2 B:A arrangement. Conversion of the hydrotreated product to distillates in a catalytic cracking unit is greater for an oil which is hydrotreated more severely. Thus the preferred hydrotreating catalyst system results in greater conversion for a given amount of residue in an oil relative to other hydrotreating catalysts when compared on an equal catalyst life basis.

What is claimed is:

1. A process for converting residual hydrocarbon oils to catalytic cracking feedstocks which comprises:

mixing from about 5–60%v residual oils with catalytic cracking feedstock and hydrogen and passing said mixture downwardly into a hydrotreating zone over a stacked-bed of two hydrotreating catalysts under conditions suitable to convert from about 45–75% of the sulfur compounds present to $H_2S$; said stacked bed comprising an upper bed consisting of about 15–85%v, basis total catalyst, of a high-activity hydrotreating catalyst containing from about 2–4%w nickel, from about 8–15%w molybdenum and from about 2–4%w phosphorus supported on a carrier consisting mostly of alumina, said catalyst having a compacted bulk density of about 0.7–0.95 gm/cc and a surface area greater than 140 $m^2$/gm; and a lower bed consisting of about 15–85%v, basis total catalyst, of a high-activity desulfurization catalyst which contains from about 2–4%w cobalt and/or nickel and from about 8–15%w molybdenum and less than about 0.5%w phosphorus supported on a carrier consisting mostly of alumina, said catalyst having a compacted bulk density of about 0.6–0.8 gm/cc and a surface area greater than 180 $m^2$/gm; and separating the reaction product from said hydrotreating zone into a hydrogen-rich gas and a liquid residue-containing oil having reduced sulfur and/or heavy metal content and being suitable as a catalytic cracking feedstock.

2. The process of claim 1 wherein the lower bed catalyst contains from about 2–4%w cobalt, and essentially no nickel and no phosphorus.

3. The process of claim 1 wherein the carrier has been extruded, dried and impregnated with an aqueous solution containing the desired catalytically active metals by the dry pore volume method.

4. The process of claim 3 wherein the carrier has been extruded into a trilobe shape before impregnation.

5. The process of claim 3 wherein the carrier comprises more than 95%w gamma alumina.

6. The process of claim 5 wherein the upper bed catalyst has a compacted bulk density of about 0.76–0.88 gm/cc and a surface area greater than about 150 $m^2$/gm.

7. The process of claim 5 wherein in the lower bed catalyst has a compacted bulk density of about 0.67–0.79 gm/cc and a surface area greater than about 200 $m^2$/gm.

8. The process of claim 1 wherein the hydrotreating zone is contained in a single reactor and the upper bed of catalyst consists of about one-third of the total catalyst volume.

9. A single stage process for hydrofining heavy oils containing 5–60%v residual oils over stacked catalyst beds, which comprises:

(a) contacting said oils in a hydrofining zone under hydrodesulfurizing conditions by mixing same with hydrogen and passing the mixture downwardly over an upper bed containing a catalyst comprising a carrier, at least 95%w of which is gamma alumina, having supported thereon from about 2–4%w nickel, from about 8–15% molybdenum and from about 2–4%w phosphorus, said bed volume constituting about 15–85% of the total catalyst;

(b) thence downwardly over a lower bed containing a catalyst comprising a carrier, at least 95%w of which is gamma alumina having supported thereon from about 2–4%w cobalt and/or nickel, from about 8–15%w molybdenum and less than 0.5%w phosphorus; and (c) separating the reaction product from the hydrofining zone into a hydrogen-rich gas and a desulfurized, demetallized liquid oil product all or part of which is suitable for inclusion in a conversion process.

10. The process of claim 9 wherein the catalyst in the lower bed contains from about 2–4%w cobalt, and essentially no nickel and no phosphorus.

11. The process of claim 9 wherein the hydrofined oil is passed to a catalytic cracking process.

12. The process of claim 9 wherein the upper bed of catalyst constitutes about ⅓ of the total catalyst volume.

13. The process of claim 11 wherein all of the desulfurized liquid oil is employed as the catalytic cracking feedstock.

14. The process of claim 9 wherein the upper bed hydrofining catalyst has a compacted bulk density of about from 0.7 to 0.95 gm/cc and a surface area of more than 140 $m^2$/gm and wherein the lower bed of hydrofining catalyst has a compacted bulk density of 0.6–0.8 gm/cc and a surface area greater than 180 $m^2$/gm.

15. The process of claim 14 wherein the upper bed catalyst has a compacted bulk density of about 0.76–0.88 gm/cc and a surface area greater than about 150 $m^2$/gm and wherein the lower bed catalyst has a compacted bulk density of about 0.67–0.79 gm/cc and a surface area greater than about 200 $m^2$/gm.

16. A single stage hydrotreating process for converting residual oils containing sulfur and nitrogen compounds and metals into distillate fuels, which comprises:

(a) preparing an oil mixture which contains about 2–50%v of hydrocarbons boiling above 1000° F.;

(b) passing said mixture along with hydrogen into a hydrotreating zone under hydrodesulfurization conditions suitable to convert from about 30–80% of the sulfur compounds present in the mixture to $H_2S$;

(c) passing said hydrogen and oil mixture downwardly over a stacked-bed of hydrotreating catalysts wherein an upper bed contains a catalyst comprising a carrier consisting essentially of gamma alumina and having supported thereon from about 2–4%w nickel, from about 8–15%w molybdenum and from about 2–4%w phosphorus, said upper bed constituting 15–85% of the total catalyst volume; and wherein a lower bed contains a catalyst comprising a gamma alumina carrier having supported thereon from 2–4%w cobalt and/or nickel from about 8–15%w molybdenum and less than 0.5%w phosphorus;

(d) separating the reaction product from said hydrotreating zone into a hydrogen-rich gas and a partially desulfurized liquid heavy oil having reduced metal content; and (e) passing all or a portion of said desulfurized liquid heavy oil into a catalytic cracking process and converting same into distillate oils.

17. The process of claim 16 wherein the upper bed of catalyst constitutes about one third of the total catalyst volume.

* * * * *